US007093735B2

(12) United States Patent
Stephens

(10) Patent No.: US 7,093,735 B2
(45) Date of Patent: Aug. 22, 2006

(54) DRINKING VESSEL WITH RETRACTABLE STRAW

(76) Inventor: William Stephens, 3877 Mt. Vernon Blvd., Norton, OH (US) 44203

( * ) Notice: Subject to any disclaimer, the term of this patent is extended or adjusted under 35 U.S.C. 154(b) by 202 days.

(21) Appl. No.: 10/645,379

(22) Filed: Aug. 22, 2003

(65) Prior Publication Data

US 2005/0040175 A1 Feb. 24, 2005

(51) Int. Cl.
*A47G 19/22* (2006.01)

(52) U.S. Cl. ..... 220/705; 215/250

(58) Field of Classification Search ..... 220/705, 220/706–710; 215/250; 137/588; 251/250
See application file for complete search history.

(56) References Cited

U.S. PATENT DOCUMENTS

| | | | | | |
|---|---|---|---|---|---|
| 3,656,654 | A | * | 4/1972 | Brinkley, III. | 220/706 |
| 4,448,316 | A | * | 5/1984 | Hiroshige | 215/388 |
| 4,485,963 | A | | 12/1984 | Panicci | |
| 4,877,148 | A | * | 10/1989 | Larson et al. | 220/706 |
| 5,484,080 | A | * | 1/1996 | Blasnik et al. | 220/708 |
| 5,495,870 | A | * | 3/1996 | Dorta | 137/588 |
| 6,431,382 | B1 | * | 8/2002 | Li | 215/388 |
| 6,526,725 | B1 | | 3/2003 | Williams | |
| 2002/0170874 | A1 | * | 11/2002 | Hou | |

* cited by examiner

*Primary Examiner*—Lien M. Ngo
(74) *Attorney, Agent, or Firm*—John D. Gugliotta

(57) ABSTRACT

A drinking vessel with retractable straw is provided having a container sealed by an upper lid. A straw linearly actuated within said upper lid such as to extend in a vertical, linearly actuated manner between an extended position and a retracted position.

4 Claims, 5 Drawing Sheets

DRINKING VESSEL WITH RETRACTABLE STRAW

RELATED APPLICATIONS

There are no previously filed, nor currently any co-pending applications, anywhere in the world.

BACKGROUND OF THE INVENTION

1. Field of the Invention

The present invention relates generally to drinking vessels with attachable or integrated drinking straws and, more particularly, to an otherwise conventional drinking vessel having a button actuated, retractable straw.

2. Description of the Related Art

As is well-known in the art, drinking vessels such as cans, cups and, particularly, bottles are well known. As a particular example, bottled water is generally conventionally available in 16 or 20 ounce bottles, and carbonated beverages are also conventionally available in the same bottles or in 12 ounce cans. However, as purchased from retailers, such drinking vessels are unable to include an integrated drinking spout such as a straw and, as such, the fluid contained therein must either be consumed either by drinking directly from the nozzle of the vessel, placing of a separate straw within the beverage container, or by pouring the beverage out into a separate cup.

Numerous attempts have been made to correct for the foregoing. By way of example, the conventional method for attaching a straw to a beverage container has been by connecting a pivoting straw into the lid or cap of the container.

Consequently, a need has been felt for providing an apparatus and method which allows a user to access an attached straw to a drinking vessel with one hand.

SUMMARY OF THE INVENTION

It is therefore an object of the present invention to provide an improved drinking vessels with attachable or integrated drinking straws It is a feature of the present invention to provide an improved drinking vessels having a button actuated, retractable straw.

Briefly described according to one embodiment of the present invention, a drinking vessel with retractable drinking straw is provided as a bottle having a threaded upper spout that is threadingly engaged to a lid. The lid is formed of an upper cap covering a lower lid assembly. A retractable straw, supported on the lower lid assembly, extends in a vertical, linearly actuated manner by a lifting cam is pivotally supported by an axle and drives a spring returned transfer gear. The transfer gear functions similar to a rack-and-pinion arrangement with a series of linearly aligned, vertically extended gear detente along the outer surface of the straw.

An advantage of the present invention is that the straw can be linearly dispensed for drinking with the push of a button and using a simple, one-handed operation.

Another advantage of the present invention is that when the straw is retracted, it seals against a straw housing such as to seal the bottle volume to form a spill proof opening.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

DESCRIPTION OF THE PREFERRED EMBODIMENTS

Figure 1:
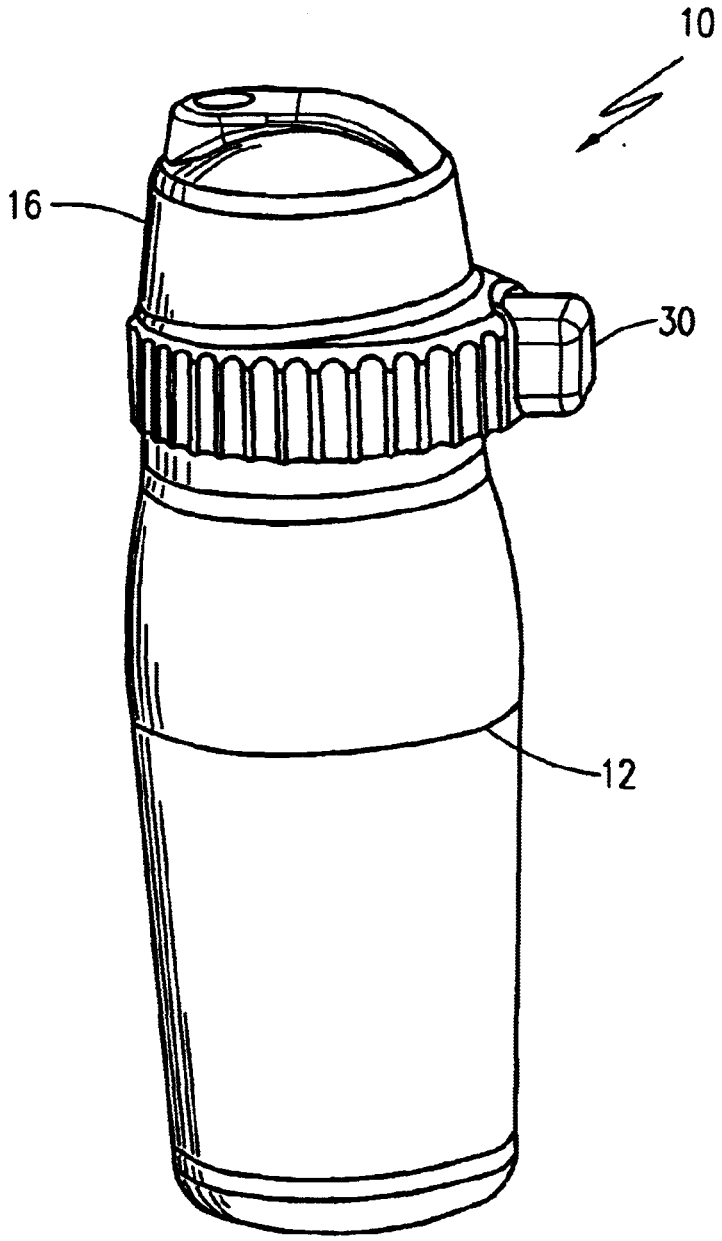
FIG. 1 is a perspective view of a drinking vessel with retractable straw according to the preferred embodiment of the present invention.

The best mode for carrying out the invention is presented in terms of its preferred embodiment, herein depicted within the FIGURES.

1. Detailed Description of the FIGURES

Referring now to FIGS. 1–4, a drinking vessel with retractable drinking straw 10 is shown, according to the present invention, having an otherwise conventional beverage container, shown herein as a bottle 12 having a threaded upper spout 14 that is threadingly engaged to a lid 16. The lid 16 is formed of an upper cap 18 covering a lower lid assembly 20. The upper cap 18 is attached to and covers a housing base 21, and forms an orifice 24 through which a retractable straw 26 extends in a vertical, linearly actuated manner. As shown best in conjunction with FIG. 4, the straw 26 forms generally cylindrical tube, and circumscribing the outer cylindrical surface of the straw 26 are a series of linearly aligned rack gears 28 are formed and engage with the radially extended gears 22*b* of a lifting cam 22*a*, as described in greater detail below. Although the tubular straw 26 forms an upper drinking orifice 40 at the end surface of the upper portion of the straw 26, the end surface of the lower portion of the straw 26 terminates at a closed engagement nipple 42. An entry orifice 44 is formed vertically along the outer cylindrical surface at the lower portion of the straw 26. In this fashion, as suction is applied to the upper drinking orifice 40 fluid is drawn side-ways in from the entry orifice 44.

Figure 2:
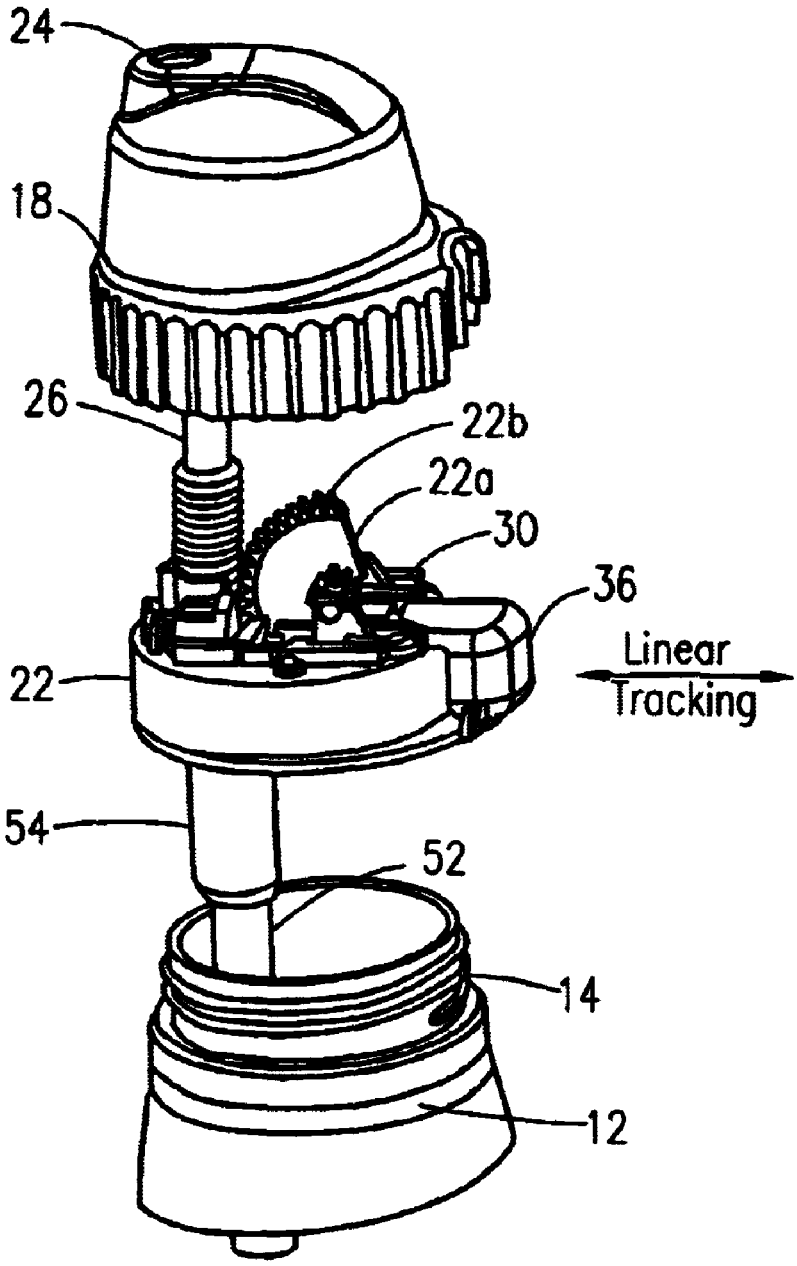
FIG. 2 is a partial exploded perspective view thereof.
Figure 3A:
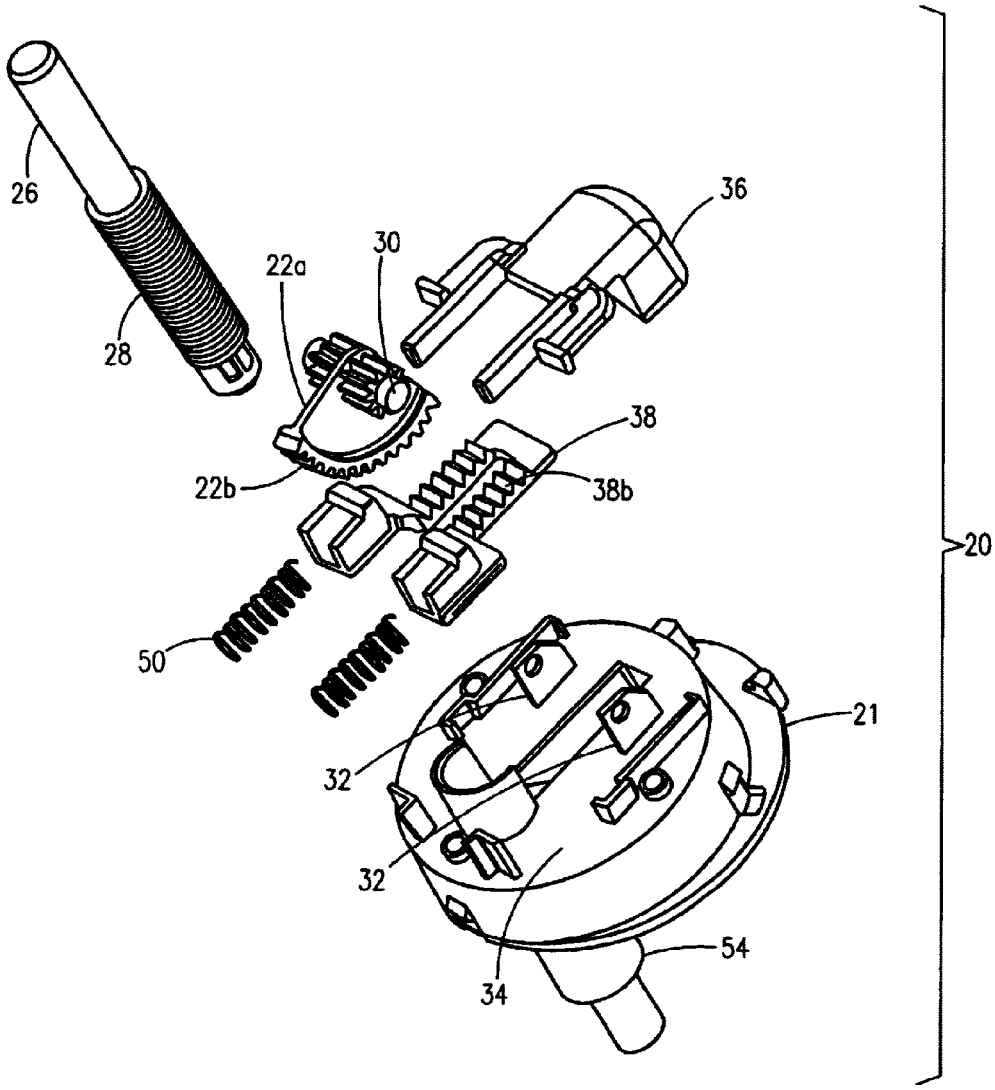
FIG. 3*a* is a top perspective view of a lower lid assembly 20 for use with the present invention.
Figure 3B:
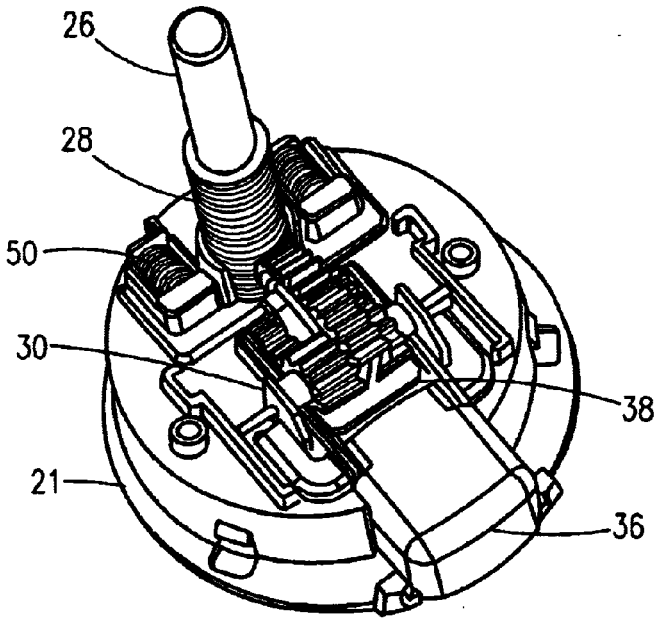
FIG. 3*b* is an exploded perspective view of the lower lid assembly of FIG. 3*a*.
Figure 4:
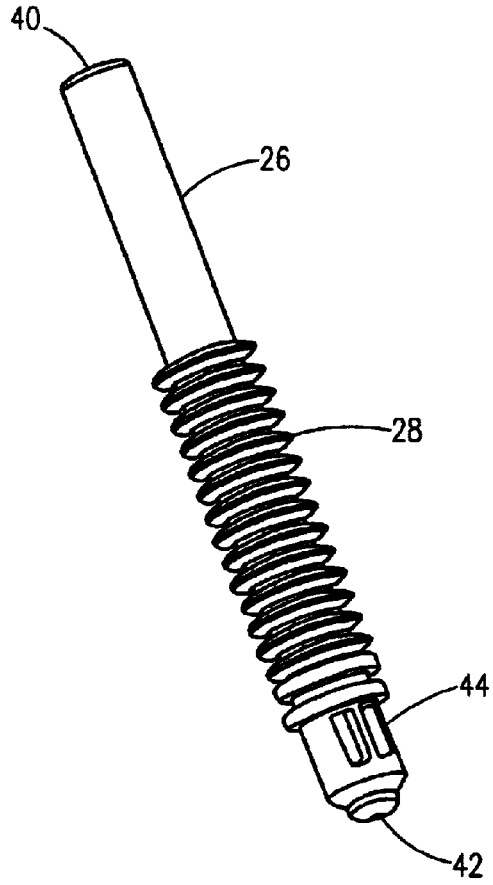
FIG. 4 is a perspective view of a retractable straw 26 for use with the present invention.

Referring to FIG. 2, in conjunction with FIG. 3*a* and FIG. 3*b*, the lower lid assembly 20 is shown and described in greater detail. The lifting cam 22*a* is pivotally supported by an axle 30 upon cam holding tabs 32 formed along the upper surface 34 of the housing base 21. A linearly tracking actuation button 36 is guided perpendicular to the lifting cam 22*a*, and drives a transfer gear 38 having series of linearly aligned, vertically extended gear detente 38*b*. The transfer gear 38 is spring urged against the actuation button 36 by at least one return spring 50.

Further, the straw 26 penetrates downward through the housing base 21 in order to form a fluid communication between the drinking orifice 40 and a lower straw housing 54. The lower straw housing 54 retains the lower portion of the straw 26, and is in fluid communication with a dip tube 52 that extends into the fluid volume of the bottle 12.

2. Operation of the Preferred Embodiment

By way of example, and not as a limitation, in accordance with a preferred embodiment of the present invention, as shown in FIG. 2, the actuation button 36 extends outwardly through the upper cap 18 such as to allow it to be manually manipulated by pressing in against the upper cap 18. The actuation button 36 horizontally tracks and drives a transfer gear 38 laterally. The vertically extended gear detente 38*b* thereby rotate the axle 30, which pivots the lifting cam 22*a* in an upward direction. As the lifting cam 22*a* rotates upward, the radially extended gears 22*b* lift against the linearly aligned rack gears 28, driving the straw 26 upward through the orifice 24. While holding the button 36, there is now fluid communication between the drinking orifice 40 and the bottle 12 such that the user can use the straw 26 to access the bottle contents.

Upon releasing the actuation button 36, the spring 50 urges the transfer gear 38 backwards to reverse the process and automatically lower the straw 26.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents. Therefore, the scope of the invention is to be limited only by the following claims.

What is claimed is:

1. A fluid vessel with a retractable straw comprising:

a container having a threaded upper spout that is threadingly engaged to a lid;

said lid formed of an upper cap covering a lower lid assembly, said upper cap attached to and covering a housing base and forming an orifice through which said retractable straw extends in a vertical, linearly actuated manner, wherein said straw forms generally cylindrical tube having a series of linearly aligned rack gears circumscribing an outer tube surface;

lifting cam having radially extended gears and pivotally supported by an axle upon a housing base;

a linearly tracking actuation button guided perpendicular to said lifting cam for driving a transfer gear having series of linearly aligned, vertically extended gear detente; and an actuation button spring urged against said transfer gear; wherein said straw penetrates downward through said lower lid assembly to form a fluid communication between a straw drinking orifice the fluid volume of the fluid vessel.

2. A fluid vessel with a sealing, retractable straw comprising:

a container having an interior volume and an upper container orifice;

an upper lid for attaching to said container and covering said upper container orifice, wherein said upper lid further comprises a lower straw housing in which the lower part of said straw;

said straw linearly actuated within said lid such as to extend in a vertical, linearly actuated manner between an extended position and a retracted position, wherein said straw further comprises an internal straw conduit circumscribed by an outer cylindrical surface, an upper drinking orifice formed at one end of said straw, a closed engagement nipple at an end surface of the lower portion of the straw, and an entry orifice formed vertically along the outer cylindrical surface at the lower portion of the straw; and lifting means for linearly actuating said straw; wherein in said extended position said straw is in fluid communication with said interior volume and in said retracted position said straw is sealed within said upper lid; and an actuation button housed with said upper lid, wherein any lateral articulation of said actuation button vertically articulates said straw.

3. The fluid vessel of claim 2, wherein said lifting means comprises:

lifting cam having radially extended gears and pivotally supported by an axle upon a housing base;

a linearly tracking of said actuation button guided perpendicular to said lifting cam for driving a transfer gear having series of linearly aligned, vertically extended gear detente; and said transfer gear spring urged against said actuation button.

4. The fluid vessel of claim 2, wherein said lifting means comprises:

lifting cam having radially extended gears and pivotally supported by an axle upon a housing base;

a linearly tracking of said actuation button guided perpendicular to said lifting cam for driving a transfer gear having series of linearly aligned, vertically extended gear detente; and said transfer gear spring urged against said linearly tracking actuation button.

* * * * *